US007348881B2

(12) United States Patent
Watkins

(10) Patent No.: US 7,348,881 B2
(45) Date of Patent: Mar. 25, 2008

(54) REFLECTIVE LAW ENFORCEMENT VEHICLE DECOY

(76) Inventor: Timothy Joseph Watkins, P.O. Box 60251, Phoenix, AZ (US) 85082

( * ) Notice: Subject to any disclaimer, the term of this patent is extended or adjusted under 35 U.S.C. 154(b) by 313 days.

(21) Appl. No.: 11/213,378

(22) Filed: Aug. 29, 2005

(65) Prior Publication Data

US 2007/0044353 A1 Mar. 1, 2007

(51) Int. Cl.
*G08B 25/00* (2006.01)

(52) U.S. Cl. ..... 340/525; 340/908.1; 340/321

(58) Field of Classification Search ..... 340/525, 340/901, 905, 908, 908.1, 473, 321; 427/152; 404/9, 12, 14; 280/1; D20/10, 35
See application file for complete search history.

(56) References Cited

U.S. PATENT DOCUMENTS 3,614,727 A * 10/1971 Fritts ..... 340/905
3,940,630 A * 2/1976 Bergonz ..... 340/991
5,830,529 A * 11/1998 Ross ..... 427/152
6,579,035 B1 * 6/2003 Watson ..... 404/14
D482,074 S * 11/2003 Gleason ..... D20/35
RE39,044 E * 3/2006 Ross ..... 427/152
2006/0175774 A1 * 8/2006 Garcia ..... 280/1

FOREIGN PATENT DOCUMENTS

GB 2245402 A * 1/1992

* cited by examiner

*Primary Examiner*—Van T. Trieu

(57) ABSTRACT

A reflective law enforcement vehicle decoy comprises an image of a law enforcement vehicles reflective areas (FIG. 2), such as pursuit lights (12*ab*), headlights (14*ab*), decals (18,) numbering area (24), spot light (16) and license plate (20) traced onto a suitable non-reflective surface and separated into groups (FIG. 4), covered with reflective material in various patterns (34,36,38,40), consistent to colors associated with a particular law enforcement agencies marking and coloring schemes, and attached to a suitable mounting platform (42) for placement along a roadway to allow passing motorist headlights to illuminate the decoy, thereby creating the illusion of a law enforcement vehicle (10), causing motorist to reduce speed in targeted areas.

1 Claim, 5 Drawing Sheets

LAW ENFORCEMENT VEHICLE DECOY

LAW ENFORCEMENT VEHICLE DECOY

FIG 2
LAW ENFORCEMENT VEHICLE IMAGE
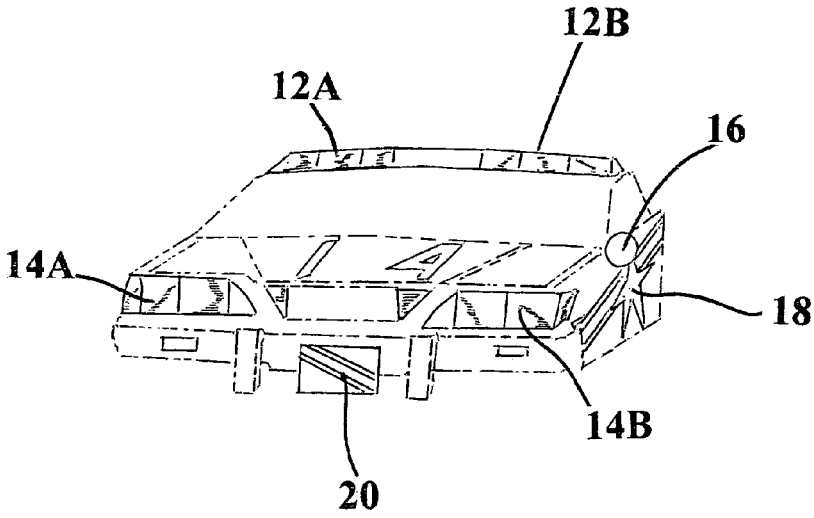
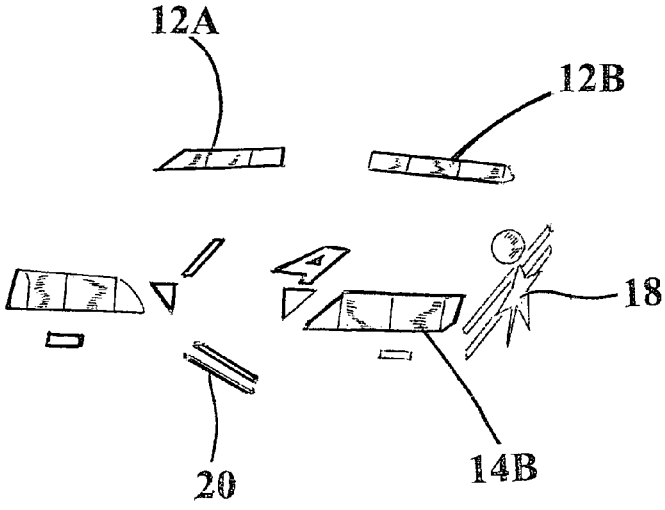
FIG 3
REFLECTIVE AREAS SEPARATED FROM LAW ENFORCEMENT VEHICLE IMAGE

REFLECTIVE AREA TEMPLATES DISPOSED ON SEPARATED GROUPS

REFLECTIVE MATERIAL PLACEMENT

FRAME ASSEMBLY

GROUPS AFFIXED TO FRAME ASSEMBLY

REFLECTIVE LAW ENFORCEMENT VEHICLE DECOY

BACKGROUND

1. Field of Invention

This invention relates to the placement of suitable colored and shaped reflective materials consistent with colors and shapes associated with a law enforcement vehicle to create the illusion of a stationary law enforcement vehicle when strategically placed and illuminated by approaching motorist head lights.

2. Description of Prior Art

The use of traffic decoys placed at specific locations that cause motorist to reduce speed is known prior art, more specifically, decoys for altering the flow and rate of traffic are known to consist basically of familiar, expected and obvious configurations such as an empty law enforcement cruiser with a dummy patrolman dressed in a uniform, and card board cut out of a patrol vehicle. The current invention is directed toward improving the use of decoys, more specifically, law enforcement vehicle when strategically placed in high risk areas during hours of reduced lighting.

In respect, the reflective law enforcement vehicle decoy according to the present invention substantially decreases the conventional concepts, and in doing so provides a device primarily developed for the purpose of creating the illusion of a staged law enforcement vehicle when illuminated by approaching head lights.

The present invention achieves its intended objects and advantages through a new and useful unobvious combination of methods, steps and components with the use of a minimum number of functional parts and at a reasonable cost to manufacture with readily available materials.

OBJECTS AND ADVANTAGES

Accordingly, besides the objects and advantages of this inventions process to create the illusion of a parked highway patrol vehicle when illuminated by approaching vehicle head lights, several additional objects and advantages of my invention are:

(a) to provide a law enforcement vehicle decoy that can be universally applied to a wide body of reduced light hazardous driving areas, (b) provides a law enforcement vehicle decoy that is easy to manufacture at an inexpensive price, (c) provides a decoy that is light weight and several can easily be transported by one person to multiple locations.

The foregoing has outlined some of the more pertinent objects of the invention. These objects should be construed to be merely illustrative of some of the more prominent features and applications of the present invention. Many other beneficial results can be attained by applying the disclosed in a different manner or by modifying the invention within the scope of the disclosure.

Therefore, it can be appreciated that there exist a continuing need for a reflective law enforcement vehicle decoy, in this, the present invention substantially fills this need. The prior art and commercial techniques do not suggest the inventive combination of component elements and features configured as disclosed and claimed herein.

Still further objects and advantages will become apparent from a consideration of ensuing description and drawings.

DRAWING FIGURES

In the drawings, closely related figures have the same number but different alphabetical suffixes.

FIG. 2 shows a perspective view illustrating a image of a law enforcement vehicle.

FIG. 3 shows a perspective view illustrating the reflective areas associated with a law enforcement vehicle separated from vehicle image

Reference Numerals in Drawings

| | | | |
|---|---|---|---|
| 10 | reflective law enforcement decoy | 12ab | light bar reflective areas |
| 14ab | headlight reflective areas | 16 | spot light reflective area |
| 18 | side decal reflective area | 20 | license plate reflective area |
| 22ab | light bar group | 24 | hood decal group |
| 26 | side decal group | 28 | left headlight group |
| 30 | right headlight group | 32al | group fastener insert opening |
| 34 | solid reflective pattern | 36 | vertical striped reflective pattern |
| 38 | circular reflective pattern | 40 | horizontal reflective pattern |
| 42 | frame assembly | 44al | frame assembly insert openings |
| 46af | group numbering | 48ac | frame group numbering |

SUMMARY

In accordance with the present invention, a reflective law enforcement vehicle decoy comprises a three dimensional image, to scale or modified, of a highway patrol vehicles reflective areas disposed on a suitable dark non-reflective surface, affixed to a suitable mounting frame and transported to a desired location to create the illusion of a highway patrol vehicle when illuminated by approaching motorist headlights.

These together with other objects of the invention, along with the various features of novelty which characterize the invention, are pointed out with particularity in the claims annexed to and forming part of this disclosure. For a better understanding of the invention, its operating advantages and specific objects attained by its uses, reference should be made to the accompanying drawings and descriptive matter in which there are illustrated embodiments of the invention.

DESCRIPTION—FIGS. 1 TO 7

Figure 1:
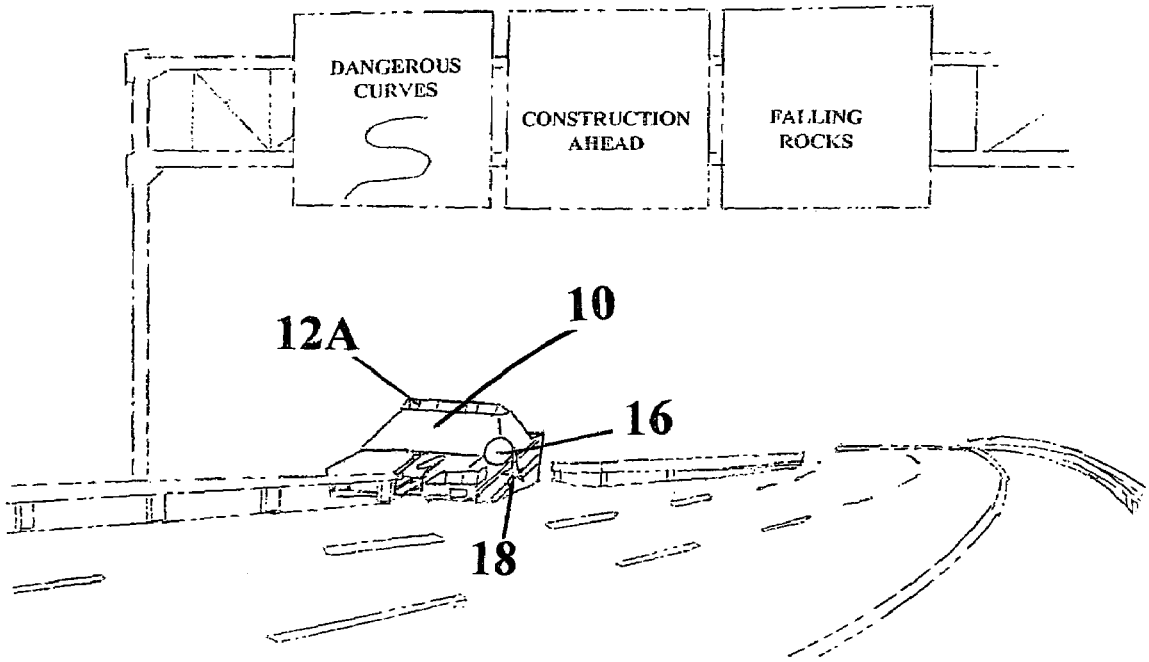
FIG. 1 shows the current invention in the preferred embodiment.
Figure 4:
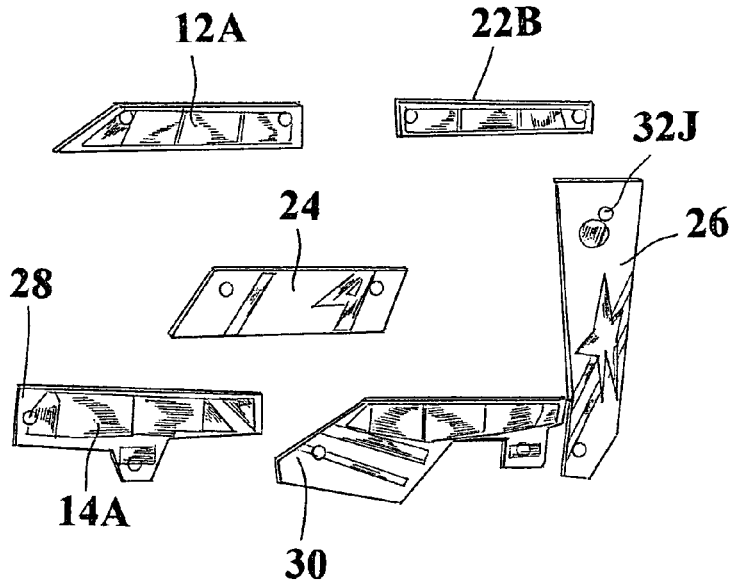
FIG. 4 shows a perspective view illustrating templates of the reflected areas placed on sectional groups.
Figure 5:
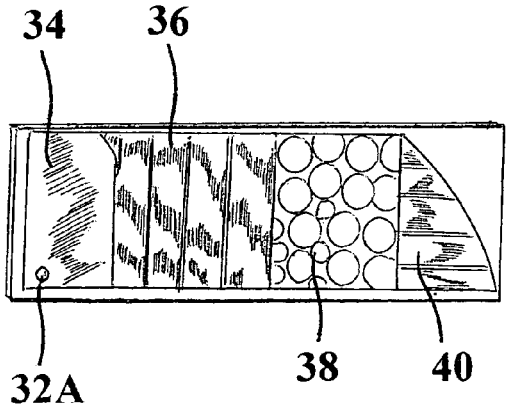
FIG. 5 shows a perspective view illustrating the placement of reflective materials onto the templates.
Figure 6:
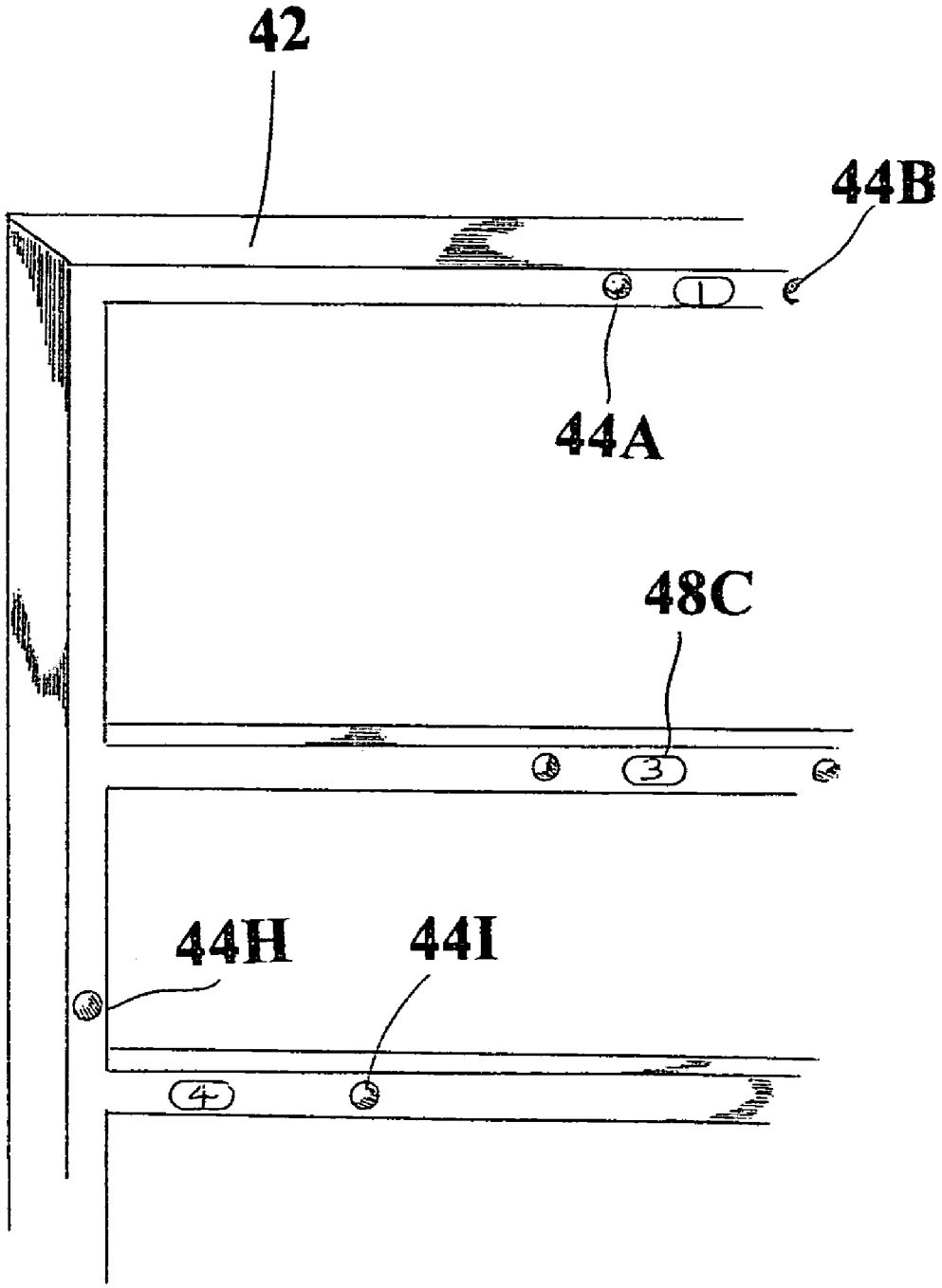
FIG. 6 shows a perspective view illustrating the frame assembly and manner of construction.
Figure 7:
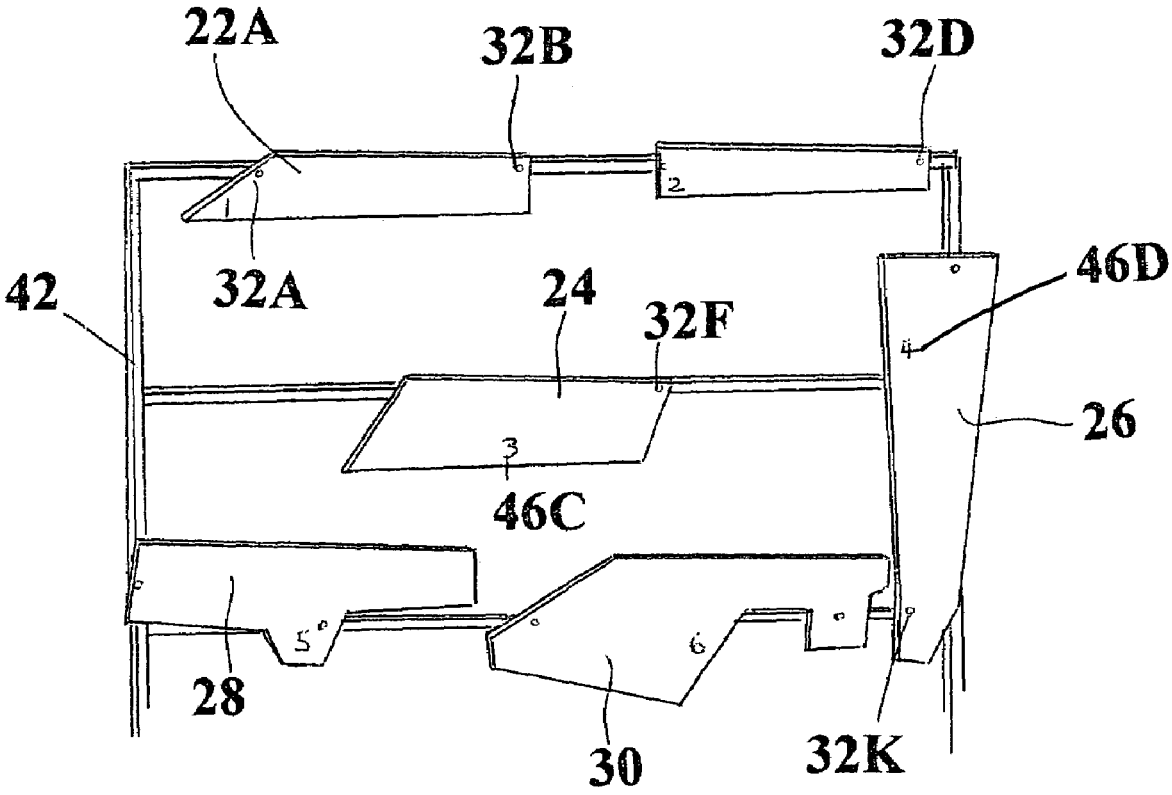
FIG. 7 shows a perspective view illustrating the method groups are connected to a frame assembly in proper orientation.

A typical embodiment of the reflective law enforcement vehicle decoy is illustrated in FIG. 1. The reflective areas associated with a law enforcement vehicle FIG. 2, to include emergency light bars 12*a,b*, left and right side headlight groups 14*a,b*, license plate 20, side decals 18, hood decal area 24, and spot light.16. The positions of the aforementioned reflective areas are traced onto a suitable dark pigmented non-reflective FIG. 3 surface either to scale or modified, in proper orientation The current invention should be made as close to scale as possible to add realism. The reflective images of the law enforcement vehicles reflective areas are separated into groups FIG. 4, that will allow the law enforcement vehicle reflective areas to properly orientated when affixed to a generally flat surface. The traced reflective area images are covered with reflective tape FIG. 5, as the preferred method in vertical stripes 36, horizontal stripes 40, circular patterns 38, solid patterns 34, or any combination thereof The reflective tape should have colors consistent with colors of a particular law enforcement agencies coloring scheme. A numbering system FIG. 6, FIG. 4, consisting of a number placed on each group 46*af* is used to insure proper group placement onto the frame assemblies corresponding number 44*af*. The groups have fastener openings FIG. 6, 32*al*, that are adapted for connection to the frame assembly 42 in fastener receiving openings 44*al*. The frame assembly 42 consist of a light-weight ridged frame assembly as the preferred method, however, any suitable mounting surface will suffice. Examples are a wall, bridge support or a banner.

From the description above, a number of advantages of this invention become evident:

(a) provides a reflective decoy that can be easily mass produced at an inexpensive cost with readily available materials, (b) provides a reflective decoy that can be made from a small photograph or full scale image, (c) provides a reflective decoy that can be ordered with custom colors and decals to match a particular law enforcement agencies coloring and lettering scheme, (d) provides a reflective decoy that allows law enforcement agencies to place an actual highway patrolman at the site of a previous placed decoy to catch local offenders that are use to the decoys presence.

OPERATION—FIGS. 1,2,3,4,5,6,7

The manner of using the reflective law enforcement decoy is to target areas where excessive speed during the hours of reduced lighting contributes to a high rate of accidents, such as highway construction projects, rural rail road crossings, icy bridges and dangerous curves.

The user should assemble the frame assembly 42 and attach the reflective groups 22*ab*, 24, 26,28, 30 to the corresponding numbers on the frame assembly 48*af*. The current invention is then placed in a location approximately 250 to 500 feet behind the target area to create the illusion of a cruiser and cause motorist to reduce their speed.

The decoy is hard to distinguish from an actual cruiser until the passing motorist has already reduced their rate of speed in the traffic hazard area. Law enforcement agencies can easily move the decoys to different positions several times a night, or bait an area by leaving a decoy for several nights and then placing a real patrolman at the location.

SUMMARY, RAMIFICATIONS AND SCOPE

Accordingly, the reader will see that the reflective law enforcement vehicle decoy can be used inexpensively and conveniently to create the illusion of a staged highway patrol vehicle which causes motorist to reduce speed a targeted locations. As to the manner of usage and operation of the present invention, the same should be apparent from the above description, accordingly, no further discussion relating to the manner of usage and operations will be provided. With respect to the above description, then it is to be realized that optimum dimensional relationships for parts of the invention, to include variations in size, materials shape, form, fit, function and manner of operation, assembly and usage, are deemed readily apparent and obvious to one skilled in the art, and all equivalents relationships to those illustrated in the drawings and described in the specifications are indeed to be encompassed by the present invention.

Therefore, the foregoing is considered as illustrative only of the principals of the invention further, since numerous modifications will readily occur by those skilled in the art, it is not desired to limit the invention to exact connection and orientation shown and described, and accordingly, all suitable modification and equivalents may be resorted to, filling within the scope of the invention. In as much as the present disclosure includes all contained in the appended clams as well as that of the foregoing description, and although this invention has been described in its preferred forms with a certain degree of particularity, it is understood that the present disclosure of the preferred form has been made only by way of example and numerous changes in details of construction and combination and arrangement of parts may be resorted to without departing from the spirit and scope of the invention. Thus the scope of the invention should be determined by appended claims and their equalivants, rather than by examples given.

What I claim is:

1. A reflective law enforcement vehicle decoy for placement in proximity to a roadway for creating the illusion of a law enforcement vehicle when illuminated by approaching motorist headlights comprising:

(a) an image of a law enforcement vehicles reflective areas from a suitable elevation is copied onto a suitable surface in orientation with said image of law enforcement vehicle, and means for covering said copied reflective areas with suitable reflective materials consistent with colors associated with said law enforcement vehicles image, and means for coupling said reflective image of law enforcement vehicle to a suitable mounting surface, and positioning said law enforcement vehicle decoy strategically in proximity to a targeted roadway so that approaching vehicle headlights illuminate said decoy, thereby creating a illusion of a staged law enforcement vehicle, respectively.

* * * * *